US010056166B2

(12) United States Patent
Okafuji

(10) Patent No.: US 10,056,166 B2
(45) Date of Patent: Aug. 21, 2018

(54) COPPER-COBALT-SILICON ALLOY FOR ELECTRODE MATERIAL

(75) Inventor: Yasuhiro Okafuji, Ibaraki (JP)

(73) Assignee: JX Nippon Mining & Metals Corporation, Tokyo (JP)

( * ) Notice: Subject to any disclaimer, the term of this patent is extended or adjusted under 35 U.S.C. 154(b) by 99 days.

(21) Appl. No.: 13/818,455

(22) PCT Filed: Aug. 24, 2011

(86) PCT No.: PCT/JP2011/069043

§ 371 (c)(1),
(2), (4) Date: Mar. 21, 2013

(87) PCT Pub. No.: WO2012/026488

PCT Pub. Date: Mar. 1, 2012

(65) Prior Publication Data

US 2013/0209825 A1 Aug. 15, 2013

(30) Foreign Application Priority Data

Aug. 24, 2010 (JP) ..... 2010-187294

(51) Int. Cl.
*C22C 9/00* (2006.01)
*C22C 9/06* (2006.01)
(Continued)

(52) U.S. Cl.
CPC ..... *H01B 1/026* (2013.01); *C22C 9/00* (2013.01); *C22C 9/06* (2013.01); *C22C 9/10* (2013.01);
(Continued)

(58) Field of Classification Search
CPC .. H01B 1/026; C22F 1/08; C22C 9/06; C22C 9/10; C22C 9/00
(Continued)

(56) References Cited

U.S. PATENT DOCUMENTS

2004/0079456 A1 4/2004 Mandigo et al.
2004/0166017 A1 8/2004 Caron et al.
(Continued)

FOREIGN PATENT DOCUMENTS

CN 1793394 A 6/2006
CN 101146920 A 3/2008
(Continued)

OTHER PUBLICATIONS

Supplemental European Search Report in European Patent Application 11819951.2, dated Mar. 14, 2007, 10 pages.
(Continued)

*Primary Examiner* — Keith Walker
*Assistant Examiner* — John A Hevey
(74) *Attorney, Agent, or Firm* — Drinker Biddle & Reath LLP

(57) ABSTRACT

Disclosed is a copper-cobalt-silicon (Cu—Co—Si) alloy for electronic material with an improved balance among electroconductivity, strength and bend formability, which includes 0.5 to 3.0% by mass of Co, 0.1 to 1.0% by mass of Si, and the balance of Cu and inevitable impurities, having a ratio of mass percentages of Co and Si (Co/Si) given as 3.5≤Co/Si≤5.0, having an average particle size of second phase particles, within the range of the particle size of 1 to 50 m seen in a cross-section taken in parallel with the direction of rolling, of 2 to 10 nm, and having an average distance between the adjacent second phase particles of 10 to 50 nm.

12 Claims, 4 Drawing Sheets

(51) Int. Cl.
*C22F 1/08* (2006.01)
*H01B 1/02* (2006.01)
*C22C 9/10* (2006.01)

(52) U.S. Cl.
CPC ..... *C22F 1/08* (2013.01); *Y10T 428/12014* (2015.01)

(58) Field of Classification Search
USPC ..... 428/546; 420/470, 485, 490, 496
See application file for complete search history.

(56) References Cited

U.S. PATENT DOCUMENTS

| | | | | |
|---|---|---|---|---|
| 2006/0137773 | A1 | 6/2006 | Aruga et al. | |
| 2008/0047634 | A1 | 2/2008 | Mihara et al. | |
| 2008/0056930 | A1 | 3/2008 | Ito | |
| 2009/0035174 | A1 | 2/2009 | Era et al. | |
| 2009/0257909 | A1 | 10/2009 | Mihara et al. | |
| 2010/0193092 | A1* | 8/2010 | Matsuo | B03C 5/005 148/682 |
| 2010/0326573 | A1 | 12/2010 | Mihara | |
| 2011/0005644 | A1 | 1/2011 | Matsuo | |
| 2011/0186192 | A1* | 8/2011 | Mihara et al. | 148/686 |
| 2011/0200479 | A1* | 8/2011 | Mihara | C22C 9/06 420/470 |
| 2011/0200480 | A1 | 8/2011 | Matsuo | |
| 2011/0244260 | A1* | 10/2011 | Kuwagaki | 428/546 |
| 2013/0087255 | A1* | 4/2013 | Kuwagaki | 148/554 |

FOREIGN PATENT DOCUMENTS

| | | | | |
|---|---|---|---|---|
| EP | 1873266 | A1 | 1/2008 | |
| JP | 2009020943 | A | 1/1997 | |
| JP | H10-219374 | A | 8/1998 | |
| JP | 2005-532477 | A | 10/2005 | |
| JP | 2006-200036 | A | 8/2006 | |
| JP | 2006-265731 | A | 10/2006 | |
| JP | 2007-169764 | A | 7/2007 | |
| JP | 2007-169765 | A | 7/2007 | |
| JP | 2007-169781 | A | 7/2007 | |
| JP | 200856977 | A | 3/2008 | |
| JP | 2008-248333 | A | 10/2008 | |
| JP | 2009-242926 | A | 10/2009 | |
| JP | 2009242814 | A | 10/2009 | |
| JP | 2009242890 | | 10/2009 | |
| WO | WO-2004/005560 | A2 | 1/2004 | |
| WO | WO-2006101172 | A1 | 9/2006 | |
| WO | WO-2006/109801 | A1 | 10/2006 | |
| WO | WO-2008032738 | A1 | 3/2008 | |
| WO | 2009096546 | A1 | 8/2009 | |
| WO | 2009116649 | A1 | 9/2009 | |
| WO | 2010013790 | A1 | 2/2010 | |
| WO | 2010016428 | A1 | 2/2010 | |
| WO | WO2010016429 | * | 2/2010 | C22C 9/06 |
| WO | WO-2010064547 | A1 | 6/2010 | |

OTHER PUBLICATIONS

Office Action dated Dec. 4, 2014 for U.S. Appl. No. 13/131,718.
Office Action dated Apr. 24, 2014 for U.S. Appl. No. 13/131,718.
Office Action dated Dec. 19, 2013 for U.S. Appl. No. 13/131,718.
Office Action dated Aug. 27, 2014 for U.S. Appl. No. 13/701,267.
Office Action dated Jan. 3, 2014 for U.S. Appl. No. 13/701,267.
Office Action dated Aug. 30, 2013 for U.S. Appl. No. 13/701,267.
Office Action dated Apr. 8, 2015 for U.S. Appl. No. 13/701,267.
Office Action dated Apr. 22, 2015 for U.S. Appl. No. 13/131,718.
Office Action dated Oct. 22, 2015 for U.S. Appl. No. 13/131,718.
Office Action dated Aug. 10, 2016 from U.S. Appl. No. 13/131,718.

* cited by examiner

COPPER-COBALT-SILICON ALLOY FOR ELECTRODE MATERIAL

TECHNICAL FIELD

The present invention relates to a precipitation-hardened copper alloy, and in particular a copper-cobalt-silicon (Cu—Co—Si) alloy suitable for use for various electronic components.

BACKGROUND ART

Copper alloy for electronic material used for various electronic components such as connector, switch, relay, pin, terminal, leadframe and so forth is basically required to satisfy both of high strength and high electro-conductivity (or heat conductivity). With recent accelerated progress in higher integration, downsizing and thinning of electronic components, more advanced levels of requirement have been directed to the copper alloy used for components of electronic instruments. In particular, the copper alloy used for floating connector and so forth has come to be used under larger current. In order to prevent dimensional expansion of the connector, the copper alloy necessarily has a good bend formability even if thickened (0.3 mm or more), an electro-conductivity of 60% (65) IACS or larger, and a 0.2% yield strength of approximately 650 MPa or larger.

Cu—Ni—Si alloy, generally referred to as Corson-series alloy, is a representative copper alloy showing relatively large electro-conductivity, strength and bend formability. This sort of copper alloy is improved in the strength and electro-conductivity, by allowing fine Ni—Si intermetallic compound grains to deposit in a copper matrix. It is, however, difficult for the Cu—Ni—Si alloy to achieve an electro-conductivity of 60% IACS or larger, while keeping a desirable strength. Under the circumstances, Cu—Co—Si alloy is now gathering attention. The Cu—Co—Si alloy is advantageously adjustable to show larger electro-conductivity than the Cu—Ni—Si alloy, by virtue of its lower solid solubility of cobalt silicide ($Co_2$ Si).

Processes largely affective to characteristics of the Cu—Co—Si alloy include solution treatment, aging and finish rolling, among which the aging is one of the process most affective to distribution or grain size of deposits of cobalt silicide.

Patent Literature 1 (JP-A-09-20943) describes a Cu—Co—Si alloy which is developed aiming at higher strength, higher electro-conductivity and larger bend formability. A method of manufacturing the copper alloy described herein is such as including hot rolling, subsequent cold rolling with a reduction of 85% or more, annealing at 450 to 480° C. for 5 to 30 minutes, cold rolling with a reduction of 30% or less, and aging at 450 to 500° C. for 30 to 120 minutes.

Patent Literature 2 (JP-A-2008-56977) describes compositions of copper alloys, as well as a Cu—Co—Si alloy designed while taking size and total content of inclusions possibly appear in the copper alloy into account. Also described is a method which includes solution treatment, and subsequent aging at 400° C. or above and 600° C. or below, for 2 hours or longer and 8 hours or shorter.

Patent Literature 3 (JP-A-2009-242814) describes a Cu—Co—Si alloy introduced as a precipitation-hardened copper alloy material, expected to stably achieve a high level of electro-conductivity of 50% TAGS or above which is hardly achieved by the Cu—Ni—Si alloy. The literature also describes a method including steps of facing, subsequent aging at 400 to 800° C. for 5 seconds to 20 hours, cold rolling with a reduction of 50 to 98%, solution treatment at 900° C. to 1050° C., and aging at 400 to 650° C., taking place in this order.

Patent Literature 4 (WO2009-096546) describes a Cu—Co—Si alloy characterized in that size of deposit containing both of Co and Si is 5 to 50 nm. The literature also describes that aging after solution recrystallization is preferably conducted at 450 to 600° C. for 1 to 4 hours.

Patent Literature 5 (WO2009-116649) describes a Cu—Co—Si alloy excellent in strength, electro-conductivity, and bend formability. Examples of the literature describe the aging at 525° C. for 120 minutes, rate of heating from room temperature up to the maximum temperature fallen in the range from 3 to 25° C./min, and a rate cooling in furnace, down to 300° C., of 1 to 2° C./min.

Patent Literature 6 (WO2010-016428) describes a Cu—Co—Si alloy successfully improved in strength, electro-conductivity, and bend formability, by adjusting a value of Co/Si to 3.5 to 4.0. The literature also describes that the aging after recrystallization is proceeded at 400 to 600° C. for 30 to 300 minutes (at 525° C. for 2 hours in Example), the heating rate is adjusted to 3 to 25K/min, and the cooling rate is adjusted to 1 to 2K/min. The bend formability is evaluated by 90° W-bending test at R/t=0 and 180°-bending test at R/t=0.5, wherein samples are rated as "good" if bendable at least either in good way (GW) or bad way (BW). The rating, however, includes the case where the samples are rated as "good" in GW, but rated as "bad" in BW, only with a limited accuracy of evaluation for R/t. Moreover, the evaluation is only available up to a thickness as small as 0.2 mm, but not available at a thickness as thick as 0.3 mm.

CITATION LIST

Patent Literature

Patent Literature 1, JP-A-09-20943

Patent Literature 2, JP-A-2008-56977

Patent Literature 3, JP-A-2009-242814

Patent Literature 4, International Patent Publication No. 2009-096546

Patent Literature 5, International Patent Publication No. 2009-116649

Patent Literature 6, International Patent Publication No. 2010-016428

SUMMARY OF THE INVENTION

Problem to be Solved

Having described above, despite of various proposals on improvement in the characteristics of Cu—Co—Si alloy, optimum conditions for aging have not been established, leaving a room for improvement in the state of precipitation of second phase particles represented by cobalt silicide. While WO2009-096546 describes control of the size of the second phase particles which contributes to the strength and so forth, Example of which actually shows only results of observation at 100,000× magnification. Such level of magnification is, however, insufficient to accurately measure the size of deposit of 10 nm or smaller. Moreover, while WO2009-096546 describes the size of precipitate ranging from 5 to 50 nm, all samples shown in Inventive Example have average grain sizes of 10 nm or larger.

It is therefore an object of the present invention to provide a Cu—Co—Si alloy with an improved balance among electro-conductivity, strength and bend formability, by improving the state of precipitation of the second phase particles.

Means to Solve the Problem

The present inventor extensively investigated into relation between distribution of ultrafine second phase particles of 1 to 50 nm or around and alloy characteristics, through observation under a transmission electron microscope (TEM) at 1,000,000× magnification, and found that the grain size of the ultrafine second phase particles and distance between the adjacent second phase particles significantly affect the alloy characteristics. The present inventor also found that the balance among electro-conductivity, strength and bend formability of the Cu—Co—Si alloy was improved, by controlling, by appropriate aging, the average grain size of the second phase particles and distance between the adjacent second phase particles.

According to one aspect of the present invention completed based on the findings described above, there is provided a copper alloy for electronic material which includes 0.5 to 3.0% by mass of Co, 0.1 to 1.0% by mass of Si, and the balance of Cu and inevitable impurities, having a ratio of mass percentages of Co and Si (Co/Si) given as $3.5 \leq Co/Si \leq 5.0$, having an average particle size of second phase particles, within the range of the particle size of 1 to 50 nm seen in a cross-section taken in parallel with the direction of rolling, of 2 to 10 nm, and having an average distance between the adjacent second phase particles of 10 to 50 nm.

According to another aspect of the present invention, there is provided the copper alloy for electronic material having an average crystal grain size, seen in a cross-section taken in parallel with the direction of rolling, of 3 to 30 μm.

According to another aspect of the present invention, there is provided the copper alloy for electronic material further containing at least any one alloying element selected from the group consisting of Ni, Cr, Sn, P, Mg, Mn, Ag, As, Sb, Be, B, Ti, Zr, Al and Fe, and, with a total content of the alloying element(s) of 2.0% by mass or less.

According to another aspect of the present invention, there is provided wrought copper alloy products obtained by processing the copper alloy for electronic material of the present invention.

According to another aspect of the present invention, there is provided an electronic component which includes the copper alloy for electronic material of the present invention.

Effects of Invention

According to the present invention, a Cu—Co—Si alloy with an improved balance among strength, electro-conductivity and bend formability may be obtained.

DESCRIPTION OF EMBODIMENTS

Composition

Figure 1:
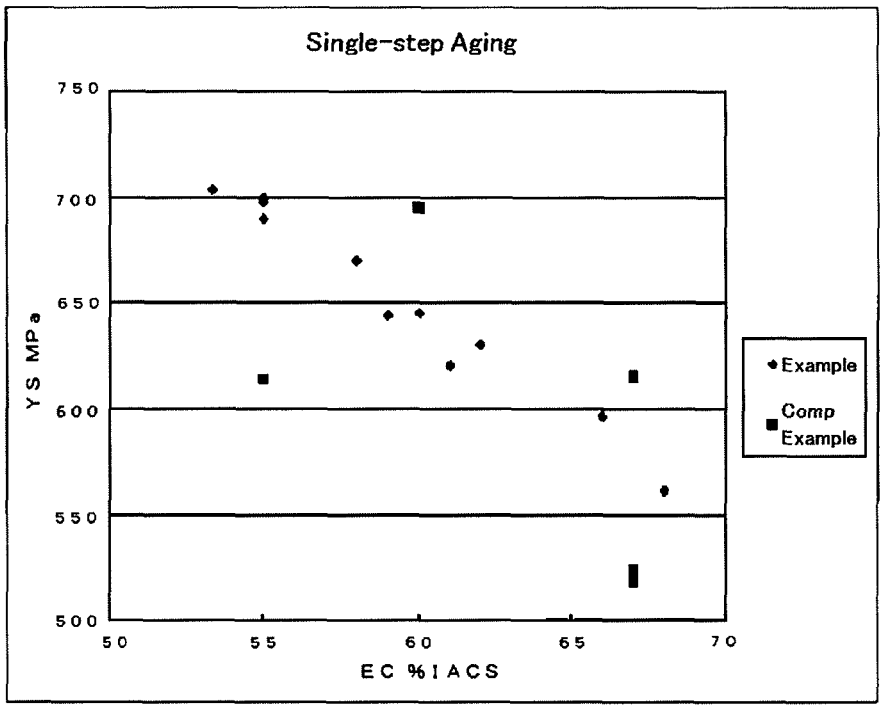
FIG. 1-A plot of relations between electro-conductivity (EC) and 0.2% yield strength (YS) for Inventive Example Nos. 1 to 11 and Comparative Example Nos. 34 to 39, manufactured by single-step aging.
Figure 2:
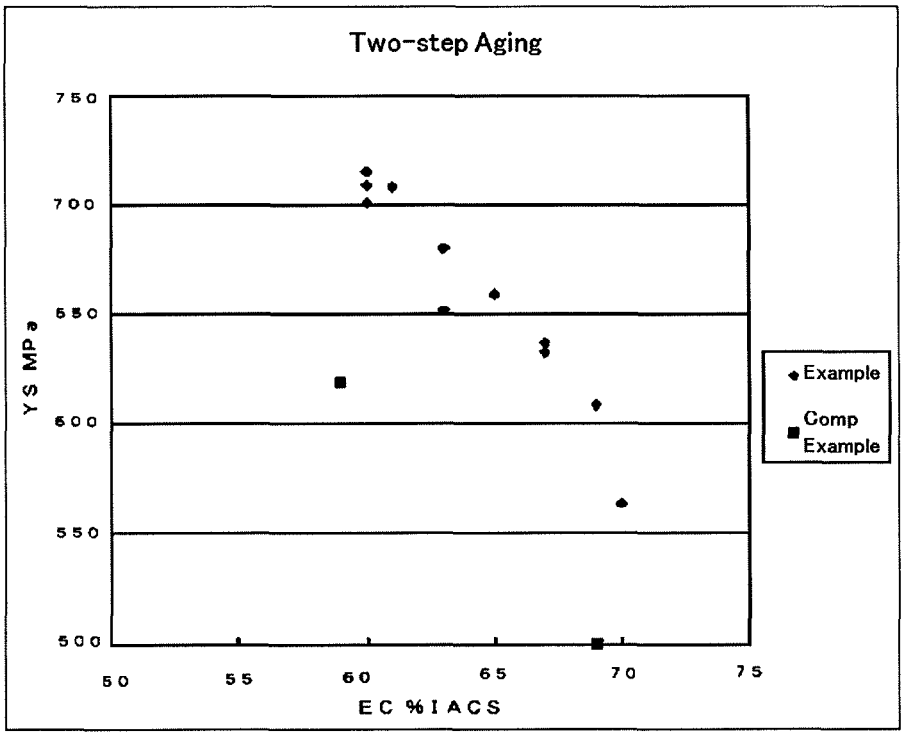
FIG. 2-A plot of relations between electro-conductivity (EC) and 0.2% yield strength (YS) for Inventive Example Nos. 12 to 22 and Comparative Example Nos. 40 and 41, manufactured by two-step aging.
Figure 3:
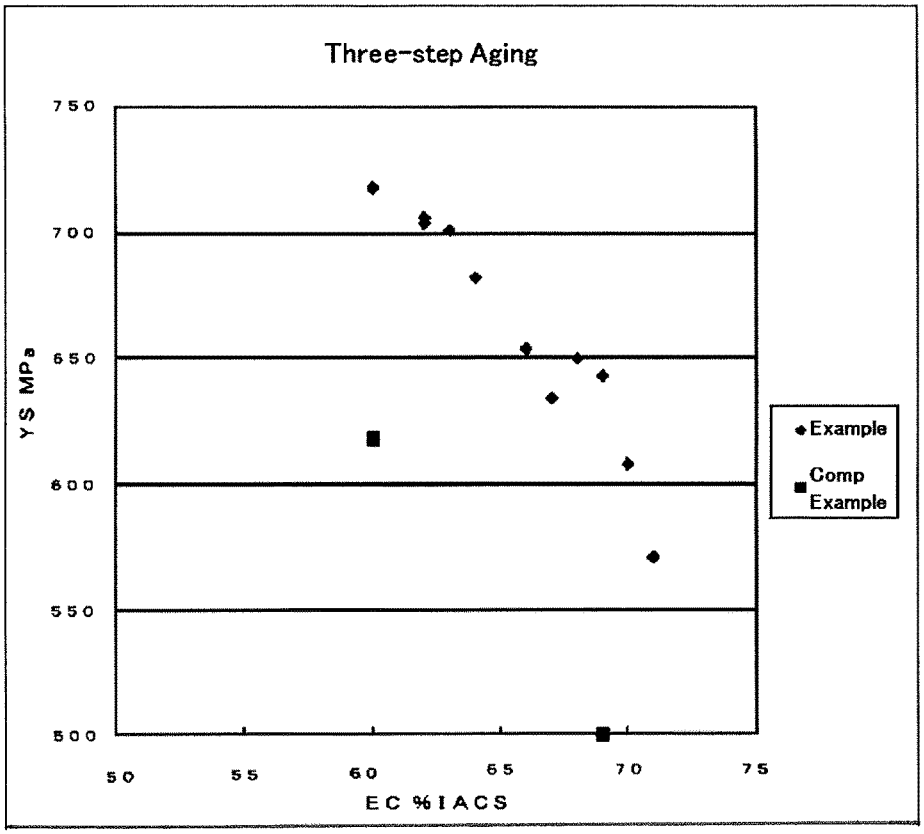
FIG. 3-A plot of relations between electro-conductivity (EC) and 0.2% yield strength (YS) for Inventive Example Nos. 23 to 33 and Comparative Example Nos. 42 and 43, manufactured by three-step aging.

The copper alloy for electronic material of the present invention contains 0.5 to 3.0% by mass of Co, 0.1 to 1.0% by mass of Si, and the balance of Cu and inevitable impurities, has a ratio of mass percentages of Co and Si (Co/Si) given as $3.5 \leq Co/Si \leq 5.0$.

If the Co content is too small, the copper alloy will fail to obtain strength necessary for electronic components such as connector, whereas if excessive, the copper alloy will produce a precipitated phase during casting which is causative of casting crack, and will reduce hot workability which is causative of crack during hot rolling. The range of 0.5 to 3.0% by mass was thus determined. The Co content is preferably 0.7 to 2.0% by mass.

If the Si content is too small, the copper alloy will fail to obtain strength necessary for electronic components such as connector, whereas if excessive, the copper alloy will considerably degrade the electro-conductivity. The range of 0.1 to 1.0% by mass was thus determined. The Si content is preferably 0.15 to 0.6% by mass.

Composition of cobalt silicide, which composes the second phase particles contributive to improvement in the strength, is $Co_2Si$, so that mass ratio of Co and Si (Co/Si) of 4.2 might be the best choice for efficiently improving the characteristics. The mass ratio of Co and Si largely departing from this value means excess of either element. The excessive element is inappropriate since it will no longer contribute to improvement in the strength, and will even degrade the electro-conductivity. For this reason, the ratio of mass percentage of Co and Si in the present invention is given as $3.5 \leq Co/Si \leq 5.0$, and preferably given as $3.8 \leq Co/Si \leq 4.5$.

Addition of a predetermined amount of at least one element selected from the group consisting of Ni, Cr, Sn, P, Mg, Mn, Ag, As, Sb, Be, B, Ti, Zr, Al and Fe will be effective in improving the strength, electro-conductivity, bend formability, platability, and hot workability through refinement of cast structure, depending on species of element. In this case, an excessive total content of the alloying element(s) will result in distinct degradation in the electro-conductivity and manufacturability, so that the total content is 2.0% by mass at the maximum, and preferably 1.5% by mass at the maximum. On the other hand, in view of obtaining a sufficient level of effect, the total content of the alloying element(s) is preferably 0.001% by mass or more, and more preferably 0.01% by mass or more.

Content of each alloying element is preferably 0.5% by mass at the maximum. If the amount of addition of each alloying element exceeds 0.5% by mass, not only the above-described effect will saturate, but also the electro-conductivity and manufacturability will degrade to a considerable degree.

Second Phase Particles

In the present invention, "second phase particles" generally represent the entire range of particles having composition different from that of the matrix, and encompasses those composed of intermetallic compound of Co and Si (cobalt silicide), and those containing Co and Si, and additional elements or inevitable impurities.

In the present invention, the second phase particles of 1 to 50 nm in diameter, seen in a cross-section taken in parallel with the direction of rolling, are specified both in terms of the average particle size and average distance between the adjacent particles. The alloy characteristics may be improved by controlling the size of such ultrafine second phase particles and the distance between the adjacent second phase particles.

More specifically, in a cross-section taken in parallel with the direction of rolling, if the average particle size of the second phase particles, having the size ranging from 1 to 50 nm is too large, the copper alloy will be more unlikely to achieve a sufficient level of strength, whereas if too small, the copper alloy will be more unlikely to achieve a sufficient level of electro-conductivity. For this reason, the average particle size is preferably controlled to 2 to 10 nm, and more preferably to 2 to 5 nm.

It is also important to control not only the average particle size, but also the average distance between the adjacent second phase particles. High strength may be obtained by reducing the average distance between the adjacent second phase particles, so that the average distance between the adjacent second phase particles is preferably adjusted to 50 nm or smaller, and more preferably 30 nm or smaller. The lower limit value is 10 nm, taking a possible amount of precipitation of additional element, and the diameter of precipitate into consideration.

In the present invention, the average particle size of the second phase particles is measured by the procedures described below. A photographs is taken under a transmission electron microscope at 1,000,000× magnification, so that 100 or more second phase particles of 1 to 50 nm in diameter are contained in the field, long diameter of each particle is measured, and the total is divided by the number of particles to give the average particle size. The long diameter herein means length of line which connects two furthest points on the contour line of each second phase particle in the field of observation.

In the present invention, the average distance between the adjacent second phase particles is determined according to the procedures below. A photographs is taken under a transmission electron microscope at 1,000,000× magnification, so that 100 or more second phase particles of 1 to 50 nm in diameter are contained in the field, and (the number of second phase particles in field of observation)÷(area of observation×thickness of sample) is calculated, and the quotient to the one over 3 power (the cube root of the quotient) is determined.

Crystal Grain Size

Crystal grain affects the strength. Since the strength is known to generally follow the Hall-Petch relationship which describes that the strength is proportional to the crystal grain size to the minus one-half power, so that, the smaller crystal grain size is the better. However, in the precipitation-hardened alloy, it is necessary to pay attention to the state of precipitation of the second phase particles. In the aging, while the second phase particles deposited in the crystal grains contribute to improve the strength, the second phase particles deposited in the grain boundary hardly contribute to improve the strength. Accordingly, the smaller the crystal grains will be, the greater the ratio of the boundary reaction in the precipitation reaction will be, so that the boundary precipitation which is almost not contributive to improvement in the strength becomes predominant. If the crystal grain size is smaller than 3 μm, a desirable level of strength will not be obtained. On the other hand, coarse crystal grains will degrade the bend formability.

From the viewpoint of obtaining a desired level of strength and bend formability, the average crystal grain size is preferably adjusted to 3 to 30 μm. Moreover, from the viewpoint of satisfying both of high strength and satisfactory bend formability, the average crystal grain size is more preferably controlled to 5 to 15 μm.

Strength, Electro-Conductivity and Bend Formability

In one embodiment, the Cu—Co—Si alloy of the present invention may have a 0.2% yield strength (YS) of 500 to 600 MPa, and an electro-conductivity of 65 to 75% IACS, preferably a 0.2% yield strength (YS) of 600 to 650 MPa, and, an electro-conductivity of 65 to 75% IACS, and more preferably a 0.2% yield strength (YS) of 650 MPa or larger, and, an electro-conductivity of 65% IACS or larger.

In one embodiment, the Cu—Co—Si alloy of the present invention may be designed to have an MBR/t of 1.0 or smaller, preferably 0.5 or smaller, and more preferably 0.1 or smaller, wherein MBR/t is a value obtained by dividing minimum bend radius (MBR) not causative of crack at bent portion (MBR) by the thickness (t), which is 0.3 mm herein, observed in the Badway W-bend test in which the sample is bent (with the axis of bending aligned in the same direction as the direction of rolling) using W-shaped dies.

Method of Manufacturing

Next, a method of manufacturing the copper alloy of the present invention will be explained.

The copper alloy of the present invention may be manufactured by a process of manufacturing a corson alloy, except for some modification made on a part of the process.

A conventional process of manufacturing of corson copper alloy will be outlined. First, using an atmospheric melting furnace, raw materials such as electrolytic copper, Co and Si are melted, to thereby obtain a molten metal with a desired composition. The molten metal is cast into an ingot. The ingot is then hot-rolled, and repetitively cold-rolled and annealed, to be finished into a strip or sheet with a desired thickness. The annealing includes solution treatment and aging. In the solution treatment, silicide (e.g., Co—Si-based compound) is solubilized into the Cu matrix, and at the same time the Cu matrix is recrystallized. In some cases, the hot rolling may serve as the solution treatment. In the aging, the silicide (e.g., Co—Si-based compound) having been solubilized in the solution treatment is allowed to precipitate in the form of fine particles. The strength and electro-conductivity are improved in the aging. The aging is followed by cold rolling, and is further followed by stress relief annealing. Between the individual processes, arbitrarily conducted are grinding for removing the surface scale, polishing, shot blasting, and acid pickling. The solution treatment may be followed by cold rolling, and aging in this order.

In contrast to the conventional manufacturing processes described above, manufacturing of the copper alloy of the present invention needs consideration on the aspects below.

Since coarse crystal inevitably produces in the solidification process during casting, and coarse precipitate inevitably produces in the process of cooling, it is necessary to solubilize such coarse crystal and precipitate into the matrix. Accordingly, it is preferable to conduct the hot rolling, after the material was kept at 950° C. to 1070° C. for one hour or longer, and preferably for 3 to 10 hours for uniform solubilization. Such temperature condition of 950° C. or above is higher than that for other corson alloys. Solubilization may be insufficient if the holding temperature before the hot rolling is lower than 950° C., and the material may unfortunately melt if the holding temperature exceeds 1070° C.

In the hot rolling, if the material temperature is lower than 600° C., precipitation of the solubilized elements will be distinctive, and this makes it difficult to obtain high strength. For uniform recrystallization, the temperature at the end of hot rolling is preferably set to 850° C. or above. Accordingly, the material temperature in the hot rolling is preferably falls in the range from 600° C. to 1070° C., and more preferably from 850 to 1070° C. In the cooling process after completion of the hot rolling, it is preferable to set the cooling rate as fast as possible so as to suppress the precipitation of the second phase particles. Water cooling is one method of accelerating the cooling.

After the hot rolling, and after arbitrarily repeating annealing (including aging and recrystallization) and cold rolling, the material is subjected to solution treatment. In the solution treatment, it is important to reduce the number of coarse second phase particles by thorough solid solubilization, and to prevent the crystal grains from growing. More specifically, temperature of the solution treatment is set to 850° C. to 1050° C., to thereby allow solid solubilization of the second phase particles to proceed. Also faster cooling after the solution treatment is more preferable, wherein the rate of cooling is preferably set to 10° C./sec or faster.

Appropriate duration of time over which the material temperature is kept at the maximum attained temperature varies depending on concentrations of Co and Si, and maximum attained temperature. In order to prevent excessive growth of the crystal grains after the recrystallization and succeeding growth of the crystal grains, the duration of time over which the material temperature is kept at the maximum attained temperature is controlled typically to 480 seconds or shorter, preferably 240 seconds or shorter, and more preferably 120 seconds or shorter. Too short duration of time over which the material temperature is kept at the maximum attained temperature may, however, fail to reduce the number of coarse second phase particles, so that the duration of time is preferably 10 seconds or longer, and more preferably 30 seconds or longer.

The solution treatment is followed by aging. It is desired to precisely control conditions of aging in the manufacturing of the copper alloy of the present invention, because the aging is most affective to control of the state of distribution of the second phase particles. Specific conditions of aging will be explained below.

First, with respect to the rate of temperature rise over the duration ranging from a material temperature of 350° C. up to the holding temperature, an excessively high rate will reduce the number of precipitation sites, which means scarceness of the second phase particles, and will enlarge inter-particle distance of the second phase particles. On the other hand, an excessively low rate will make the second phase particles larger during the temperature rise. The rate of temperature rise is, therefore, adjusted to 10 to 160° C./h, preferably 10 to 100° C./h, and more preferably 10 to 50° C./h. The rate of temperature rise is given by (holding temperature−350° C.)/(time spent for rise of material temperature from 350° C. up to holding temperature).

Next, the holding temperature and the holding time are determined so as to satisfy the equation below:

$$4.5\times10^{16}\times\exp(-0.075x)\leq y\leq5.6\times10^{18}\times\exp(-0.075x)$$

wherein x represents the holding temperature (° C.) of the material temperature, and y represents the holding time (h) at the holding temperature. If $y>5.6\times10^{18}\times\exp(-0.075x)$ holds, the second phase particles will tend to excessively grow beyond an average particle size of 10 nm, whereas if $4.5\times10^{16}\times\exp(-0.075x)>y$ holds, the second phase particles will tend to grow only insufficiently below an average particle size of 2 nm.

For the aging, the holding temperature and the holding time are determined so as to satisfy the equation below:

$$4.5\times10^{16}\times\exp(-0.075x)\leq y\leq7.1\times10^{17}\times\exp(-0.075x).$$

Aging under such condition will readily fall the average particle size of the second phase particles within the range from 2 to 5 nm.

Figure 4:
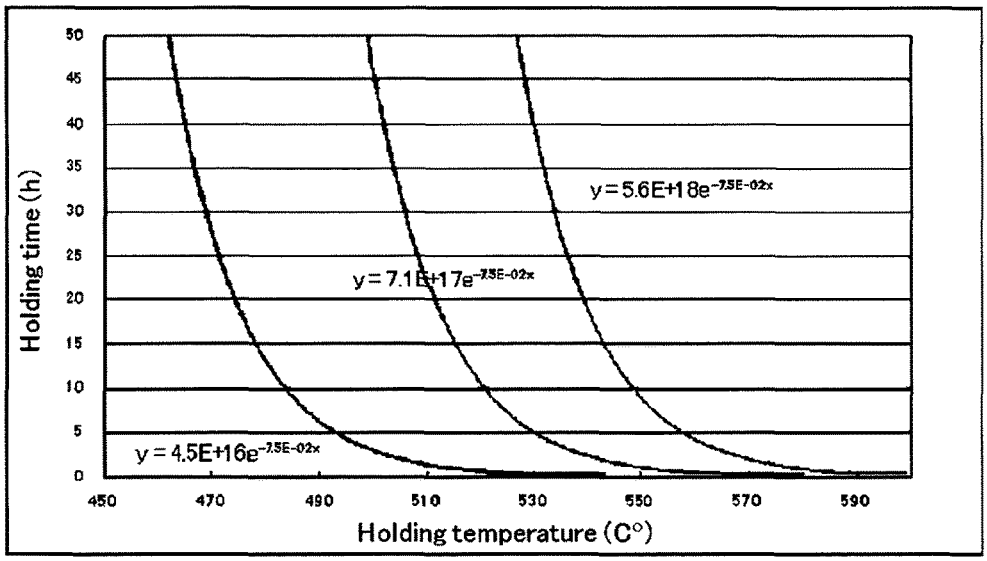
FIG. 4-A graph illustrating boundary lines for desirable conditions for aging treatment, with holding temperature (° C.) on the x-axis and holding time (h) on the y-axis.

FIG. 4 illustrates the equation above, with the holding temperature (° C.) of the material on the x-axis, and the holding time (h) at the holding temperature on the y-axis.

Lastly, with respect to the rate of temperature drop of the material temperature from the holding temperature down to 350° C., a lower rate will expectedly improve the electroconductivity. An excessively slow rate will, however, reduce the strength. The rate of temperature drop is, therefore, adjusted to 5 to 200° C./h, preferably 10 to 150° C./h, and more preferably 20 to 100° C./h. The rate of temperature drop is given by (holding temperature−350° C.)/(time, after the start of temperature drop, spent for drop of material temperature from the holding temperature down to 350° C.).

Note that, for the case where the material is processed in the order of solution treatment, cold rolling, and aging, the aging temperature may be lowered by (reduction (%)×2)° C. or around, since the material has been given stress before the aging, and so that a rapid precipitation is expectable.

More better characteristics may be obtained by multi-step aging. In more details, the first aging is conducted under the above-described condition, which is followed by the multi-step aging towards low temperatures, while adjusting difference in temperature between the adjacent steps to 20° C. to 100° C., and the holding time in the individual steps to 3 to 20 h.

The difference in temperature between the adjacent steps is set to 20° C. to 100° C., because the difference of temperature smaller than 20° C. will allow the second phase particles to excessively grow, to thereby reduce the strength, whereas the difference of temperature exceeding 100° C. will excessively reduce the rate of precipitation and will make the process less effective. The difference in temperature between the adjacent steps is preferably 30 to 70° C., and more preferably 40 to 60° C. For an exemplary case where the first-step aging is conducted at 480° C., the second-step aging may be conducted at a holding temperature of 380 to 460° C., which is lower by 20 to 100° C. from the previous. The same will apply also to the third step and thereafter. Note that there is no need of setting an unnecessarily large number of steps, since the state of distribution of the second phase particles will hardly change by the aging conducted at the holding temperature of lower than 350° C. The number of steps is preferably 2 or 3, wherein 3 is more preferable.

The holding time in the individual step is set to 3 to 20 h, because the holding time of shorter than 3 h will fail in achieving the effect, whereas the holding time exceeding 20 h will excessively prolong the aging time, and will thereby increase the manufacturing cost. The holding time is preferably 4 to 15 h, and more preferably 5 to 10 h.

While the rate of drop of the material temperature from the holding temperature down to 350° C. was described above, it is preferable also in the multi-step aging to employ the same rate of temperature drop so long as the material temperature is kept at 350° C. or above. The rate of temperature drop in the multi-step aging is given by (holding temperature at first step−350° C.)/(time, after start of temperature drop after first step, spent for drop of material temperature from the holding temperature down to 350° C.−holding time at each step). In short, the rate of temperature drop is calculated by subtracting the holding time at each step from the temperature drop time.

The aging is followed by cold rolling if necessary. Rolling reduction is preferably 5 to 40%. The cold rolling is followed by stress relief annealing if necessary. The annealing is preferably conducted at 300 to 600° C., for 5 seconds to 10 hours.

The Cu—Si—Co alloy of the present invention may be processed into various types of wrought copper alloy products, including sheet, strip, pipe, rod and wire. The Cu—Si—Co-based alloy of the present invention may be used for electronic components such as leadframe, connector, pin, terminal, relay, switch, and foil for secondary battery.

EXAMPLE

Examples of the present invention will be shown below together with Comparative Examples, which are presented merely for better understanding of the present invention and advantages thereof, and are not intended for limiting the present invention.

Example 1

Cu—Co—Si alloys, respectively containing Co, Si, and the balance of Cu and inevitable impurities according to mass concentrations listed in Table 1, were melted at 1300° C. in an Ar atmosphere in an induction melting furnace, and then cast into ingots of 30 mm thick.

The ingots were then heated to 1000° C. and kept for 3 hours, and hot rolled to a thickness of 10 mm. The material temperature at the end of hot rolling was 850° C. The products were then cooled.

Next, the products were subjected to a first aging at a material temperature of 600° C., and for a heating time of 10 hours.

Next, the products were subjected to a first cold rolling with a reduction of 95% or larger.

Next, the solution treatment was conducted at a material temperature of 850° C. for a heating time of 100 seconds for those having a Co concentration of 0.5 to 1.0% by mass; at a material temperature of 900° C. for a heating time of 100 seconds for those having a Co concentration of 1.2% by mass; at a heating temperature of 950° C. and for a heating time of 100 seconds for those having a Co concentration of 1.5 to 1.9% by mass; and at a heating temperature of 1000° C. for a heating time of 100 seconds for those having a Co concentration of 2.0% by mass or more. The products were then cooled with water.

Next, a second aging was conducted according to the conditions listed in Table 1.

Next, a second cold rolling was conducted with a reduction of 20%, to thereby obtain two types of products of 0.3 mm thick and 0.2 mm thick.

Lastly, straightening annealing was conducted at a material temperature of 400° C. for a heating time of 30 seconds, to thereby obtain test specimens. The test specimens with the same reference numeral include two types of specimens of 0.2 mm thick and 0.3 mm thick.

The processes were arbitrarily interposed by machining, acid cleaning, and degreasing.

TABLE 1

| | | Additional elements | | | 2nd Aging conditions | | | | | | Rate | Rate |
|---|---|---|---|---|---|---|---|---|---|---|---|---|
| | | | | | 1st Step | | 2nd Step | | 3rd Step | | of temp. | of temp. |
| | No | Co mass % | Si mass % | Co/Si | Aging temp. ° C. | Time h | Aging temp. ° C. | Time h | Aging temp. ° C. | Time h | rise ° C./h | drop ° C./h |
| Inventive Examples | 1 | 0.5 | 0.12 | 4.2 | 500 | 10 | | | | | 10 | 100 |
| | 2 | 0.8 | 0.2 | 4.0 | 510 | 10 | | | | | 90 | 100 |
| | 3 | 1.2 | 0.3 | 4.0 | 490 | 20 | | | | | 90 | 100 |
| | 4 | 1.2 | 0.3 | 4.0 | 510 | 10 | | | | | 150 | 100 |
| | 5 | 1.2 | 0.3 | 4.0 | 530 | 5 | | | | | 70 | 100 |
| | 6 | 1.5 | 0.3 | 5.0 | 520 | 5 | | | | | 50 | 100 |
| | 7 | 1.7 | 0.45 | 3.8 | 510 | 5 | | | | | 50 | 100 |
| | 8 | 1.9 | 0.45 | 4.2 | 550 | 5 | | | | | 45 | 100 |
| | 9 | 2.1 | 0.5 | 4.2 | 500 | 50 | | | | | 90 | 100 |
| | 10 | 2.3 | 0.46 | 5.0 | 520 | 10 | | | | | 40 | 100 |
| | 11 | 2.5 | 0.7 | 3.6 | 500 | 10 | | | | | 100 | 5 |
| | 12 | 0.5 | 0.12 | 4.2 | 500 | 10 | 450 | 5 | | | 10 | 100 |
| | 13 | 0.8 | 0.2 | 4.0 | 510 | 10 | 450 | 7 | | | 90 | 100 |
| | 14 | 1.2 | 0.3 | 4.0 | 490 | 20 | 400 | 10 | | | 90 | 100 |
| | 15 | 1.2 | 0.3 | 4.0 | 510 | 10 | 480 | 4 | | | 150 | 100 |
| | 16 | 1.2 | 0.3 | 4.0 | 530 | 5 | 490 | 5 | | | 70 | 100 |
| | 17 | 1.5 | 0.3 | 5.0 | 520 | 5 | 470 | 6 | | | 50 | 100 |
| | 18 | 1.7 | 0.45 | 3.8 | 510 | 5 | 460 | 6 | | | 50 | 100 |
| | 19 | 1.9 | 0.45 | 4.2 | 550 | 5 | 530 | 3 | | | 45 | 100 |
| | 20 | 2.1 | 0.5 | 4.2 | 500 | 50 | 450 | 5 | | | 90 | 100 |
| | 21 | 2.3 | 0.46 | 5.0 | 520 | 10 | 470 | 6 | | | 40 | 100 |
| | 22 | 2.5 | 0.7 | 3.6 | 500 | 30 | 450 | 5 | | | 100 | 100 |
| | 23 | 0.5 | 0.12 | 4.2 | 500 | 10 | 450 | 5 | 400 | 5 | 10 | 100 |
| | 24 | 0.8 | 0.2 | 4.0 | 510 | 10 | 450 | 7 | 410 | 7 | 90 | 100 |
| | 25 | 1.2 | 0.3 | 4.0 | 490 | 20 | 400 | 10 | 380 | 10 | 90 | 100 |
| | 26 | 1.2 | 0.3 | 4.0 | 510 | 10 | 480 | 4 | 420 | 4 | 150 | 100 |
| | 27 | 1.2 | 0.3 | 4.0 | 530 | 5 | 490 | 5 | 440 | 5 | 70 | 100 |
| | 28 | 1.5 | 0.3 | 5.0 | 520 | 5 | 470 | 6 | 440 | 6 | 50 | 100 |
| | 29 | 1.7 | 0.45 | 3.8 | 510 | 5 | 460 | 6 | 440 | 6 | 50 | 100 |
| | 30 | 1.9 | 0.45 | 4.2 | 550 | 5 | 530 | 3 | 430 | 3 | 45 | 100 |
| | 31 | 2 | 0.48 | 4.2 | 500 | 50 | 450 | 5 | 400 | 5 | 90 | 200 |

TABLE 1-continued

| | | Additional elements | | | 2nd Aging conditions | | | | | | Rate | Rate |
|---|---|---|---|---|---|---|---|---|---|---|---|---|
| | | | | | 1st Step | | 2nd Step | | 3rd Step | | of temp. | of temp. |
| | No | Co mass % | Si mass % | Co/Si | Aging temp. ° C. | Time h | Aging temp. ° C. | Time h | Aging temp. ° C. | Time h | rise ° C./h | drop ° C./h |
| | 32 | 2.3 | 0.46 | 5.0 | 520 | 10 | 470 | 6 | 400 | 6 | 40 | 20 |
| | 33 | 2.5 | 0.7 | 3.6 | 500 | 30 | 450 | 5 | 400 | 5 | 100 | 5 |
| Comparative | 34 | 1.2 | 0.3 | 4.0 | 480 | 5 | | | | | 50 | 100 |
| Examples | 35 | 1.2 | 0.3 | 4.0 | 550 | 20 | | | | | 50 | 100 |
| | 36 | 1.2 | 0.3 | 4.0 | 550 | 5 | | | | | 5 | 100 |
| | 37 | 0.8 | 0.2 | 4.0 | 550 | 3 | | | | | 300 | 100 |
| | 38 | 0.9 | 0.23 | 3.9 | 525 | 2 | | | | | 300 | 100 |
| | 39 | 2.4 | 0.62 | 3.9 | 525 | 2 | | | | | 300 | 100 |
| | 40 | 1.2 | 0.3 | 4.0 | 480 | 5 | 430 | 5 | | | 50 | 100 |
| | 41 | 1.2 | 0.3 | 4.0 | 550 | 20 | 500 | 5 | | | 50 | 100 |
| | 42 | 1.2 | 0.3 | 4.0 | 480 | 5 | 430 | 5 | 380 | 5 | 50 | 100 |
| | 43 | 1.2 | 0.3 | 4.0 | 550 | 20 | 500 | 5 | 450 | 5 | 50 | 100 |

Each of the thus-obtained test specimens was evaluated with respect to the various characteristics as described below.

(1) 0.2% Yield Strength (YS) and Tensile Strength (TS)

Tensile test in the direction parallel to the direction of rolling was conducted in accordance with JIS Z2241, and thereby 0.2% yield strength (YS: MPa) and tensile strength (TS: MPa) were measured.

(2) Electro-Conductivity (EC)

Volume resistivity was measured using a double bridge, and the electro-conductivity (EC: % IACS) was determined.

(3) Average Crystal Grain Size (GS)

Each test specimen was embedded into a resin so as to expose the thickness-wise cross section thereof, taken along the direction parallel to the direction of rolling, in the surface to be observed, the surface to be observed was mechanically polished to a mirror finish. One hundred parts by volume of water and 10 parts by volume of a 36% (mass concentration) hydrochloric acid were mixed, and 5% by weight, relative to the weight of the mixed solution, of iron(III) chloride was dissolved therein. In the thus-prepared solution, the specimen was dipped for 10 seconds so as to expose the metal structure. The metal structure was observed under an optical microscope at 100× magnification, and a 0.5 $mm^2$-area was photographed. Based on the photograph, the maximum diameter in the direction of rolling and the maximum diameter in the thickness-wise direction were averaged for each crystal grain, the obtained values were averaged for each field of observation, and the values obtained from 15 fields of observation were further averaged to determine the average crystal grain size.

(4) Bend Formability

W-Bending

Used were bending test specimens of 100 mm wide and 200 mm long, respectively cut out from the samples of 0.2 mm thick and 0.3 mm thick. The test pieces were subjected to the Badway W-bend test (axis of bending aligned in the same direction as the direction of rolling) using W-shaped dies, and MBR/t was determined by dividing minimum bend radius (MBR) not causative of crack at bent portion (MBR) by the thickness (t).

180° Bending

Used were bending test pieces of 100 mm wide and 200 mm long, cut out from the sample of 0.2 mm thick. The 180° bend test was conducted by bending the test pieces to 170° or around in the Bad Way with a predetermined bend radius, and then by pressing the test pieces to bend to 180° while placing in between an insertion having a thickness equal to doubled inner bending radius (R). MBR/t was determined by dividing minimum bend radius (MBR) not causative of crack at bent portion (MBR) by the thickness (t).

(5) Particle Size and Average Distance of Second Phase Particles of 1 to 50 nm in Diameter From a part of the individual test specimens, observation samples of 10 to 100 nm thick were produced using a twin jet electropolisher, and the particle size was measured under a transmission electron microscope (HITACHI-H-9000), according to the method described above. An average value from 10 fields of observation was used as each measured value.

While electropolishing, which is general for preparing samples of transmission electron microscope, was employed in this Example, the samples may be a thin film formed using FIB (Focused Ion Beam).

Results were summarized in Table 2. The results of the individual test specimens will be explained below.

Nos. 1 to 33 correspond to Inventive Examples, and each of which was found to be well-balanced among the strength, electro-conductivity and bend formability, since conditions of the second aging, succeeding to the solution treatment, were appropriate. It was also found that increase in the number of steps of aging further improved the balance. In particular, the bend formability of the 0.2 mm-thick specimens were evaluated as MBR/t=0, and also the 0.3-mm specimens showed good results.

In contrast, No. 34 showed an insufficient growth of the second phase particles with an average particle size of 2 nm or smaller, due to low temperature and short time of aging. Accordingly, the balance among the characteristics was found to be inferior to that of Inventive Examples.

No. 35 showed an excessive growth of the second phase particles with an average particle size of 10 nm or larger, due to high temperature and long time of aging. Accordingly, the balance among the characteristics was found to be inferior to that of Inventive Examples.

No. 36 showed an excessive growth, during the temperature rise, of the second phase particles with an average particle size of 10 nm or larger, due to too slow rate of temperature rise in the aging. Accordingly, the balance among the characteristics was found to be inferior to that of Inventive Examples.

No. 37 showed an inter-particle distance of 50 nm or larger, due to too rapid rate of temperature rise in the aging and a small number of sites of precipitation as a consequence. Accordingly, the balance among the characteristics was found to be inferior to that of Inventive Examples.

No. 38 and No. 39 showed values of the inter-particle distance of 50 nm or larger, due to too rapid rate of temperature rise in the aging, and a small number of sites of precipitation as a consequence. Accordingly, the bend formability was found to be inferior to that of Inventive Examples.

No. 40, which is an exemplary case where the second-step aging was added to No. 34, showed an insufficient growth of the second phase particles with an average particle size of 2 nm or smaller, due to low temperature and short time of the first-step aging. Accordingly, the balance among the characteristics was found to be inferior to that of Inventive Examples.

No. 41, which is an exemplary case where the second-step aging was added to No. 35, showed an excessive growth of the second phase particles with an average particle size of 10 m nm or larger, due to high temperature and long time of the first-step aging. Accordingly, the balance among the characteristics was found to be inferior to that of Inventive Examples.

No. 42, which is an exemplary case where the second-step aging and the third-step aging were added to No. 34, showed an insufficient growth of the second phase particles with an average particle size of 2 nm or smaller, due to low temperature and short time of the first-step aging. Accordingly, the balance among the characteristics was found to be inferior to that of Inventive Examples.

No. 43, which is an exemplary case where the second-step aging and the third-step aging were added to No. 35, showed an excessive growth of the second phase particles with an average particle size of 10 nm or larger, due to high temperature and long time of the first-step aging. Accordingly, the balance among the characteristics was found to be inferior to that of Inventive Examples.

TABLE 2

| | | | | | | 0.3 mmt W-Bending | 0.2 mmt W-Bending | 0.2 mmt 180°-Bend. | 1,000,000 × TEM: 2nd phase particles | |
|---|---|---|---|---|---|---|---|---|---|---|
| | No | YS MPa | TS MPa | EC % IACS | GS μm | (B.W.) MBR/t | (B.W.) MBR/t | (B.W.) MBR/t | Ave. D* nm | Distance nm |
| Inventive Examples | 1 | 561 | 582 | 68 | 5 | 0.0 | 0 | 0 | 2.3 | 19 |
| | 2 | 596 | 614 | 66 | 6 | 0.1 | 0 | 0 | 3.5 | 25 |
| | 3 | 645 | 655 | 60 | 15 | 0.7 | 0 | 0.1 | 2.8 | 18 |
| | 4 | 620 | 638 | 61 | 15 | 0.4 | 0 | 0 | 8.7 | 46 |
| | 5 | 630 | 642 | 62 | 15 | 0.4 | 0 | 0 | 5.0 | 31 |
| | 6 | 670 | 687 | 58 | 17 | 0.8 | 0 | 0.3 | 4.1 | 24 |
| | 7 | 690 | 702 | 55 | 20 | 0.9 | 0 | 0.3 | 3.5 | 19 |
| | 8 | 644 | 659 | 59 | 25 | 0.5 | 0 | 0.1 | 8.9 | 47 |
| | 9 | 698 | 716 | 55 | 27 | 0.9 | 0 | 0.3 | 6.0 | 31 |
| | 10 | 700 | 712 | 55 | 25 | 0.9 | 0 | 0.3 | 6.0 | 30 |
| | 11 | 704 | 714 | 53 | 22 | 0.9 | 0 | 0.3 | 4.3 | 21 |
| | 12 | 564 | 577 | 70 | 5 | 0.0 | 0 | 0 | 2.4 | 20 |
| | 13 | 609 | 621 | 69 | 6 | 0.2 | 0 | 0 | 3.5 | 24 |
| | 14 | 659 | 670 | 65 | 15 | 0.8 | 0 | 0.3 | 2.9 | 18 |
| | 15 | 633 | 650 | 67 | 15 | 0.5 | 0 | 0.3 | 8.7 | 45 |
| | 16 | 637 | 648 | 67 | 15 | 0.4 | 0 | 0 | 5.0 | 30 |
| | 17 | 680 | 690 | 63 | 17 | 0.8 | 0 | 0.4 | 4.1 | 24 |
| | 18 | 701 | 715 | 60 | 20 | 1.0 | 0 | 0.4 | 3.5 | 19 |
| | 19 | 652 | 667 | 63 | 25 | 0.5 | 0 | 0.3 | 9.0 | 47 |
| | 20 | 708 | 723 | 61 | 27 | 1.0 | 0 | 0.4 | 6.0 | 30 |
| | 21 | 709 | 727 | 60 | 25 | 0.9 | 0 | 0.4 | 6.1 | 30 |
| | 22 | 715 | 731 | 60 | 22 | 1.0 | 0 | 0.4 | 5.7 | 27 |
| | 23 | 571 | 583 | 71 | 5 | 0.0 | 0 | 0 | 2.4 | 20 |
| | 24 | 608 | 620 | 70 | 6 | 0.1 | 0 | 0 | 3.7 | 26 |
| | 25 | 650 | 663 | 68 | 15 | 0.7 | 0 | 0.2 | 2.9 | 18 |
| | 26 | 634 | 652 | 67 | 15 | 0.4 | 0 | 0.2 | 8.8 | 45 |
| | 27 | 643 | 653 | 69 | 15 | 0.4 | 0 | 0.2 | 5.2 | 32 |
| | 28 | 682 | 695 | 64 | 17 | 0.9 | 0 | 0.4 | 4.2 | 24 |
| | 29 | 701 | 719 | 63 | 20 | 1.0 | 0 | 0.4 | 3.7 | 20 |
| | 30 | 654 | 667 | 66 | 25 | 0.5 | 0 | 0.3 | 9.0 | 47 |
| | 31 | 704 | 720 | 62 | 27 | 1.0 | 0 | 0.4 | 6.2 | 32 |
| | 32 | 706 | 721 | 62 | 25 | 0.9 | 0 | 0.4 | 6.2 | 31 |
| | 33 | 718 | 732 | 60 | 22 | 1.0 | 0 | 0.4 | 5.7 | 27 |
| Comparative Examples | 34 | 614 | 624 | 55 | 15 | 0.5 | 0 | 0.5 | 1.4 | 9 |
| | 35 | 495 | 505 | 66 | 15 | 0 | 0 | 0 | 13.1 | 81 |
| | 36 | 524 | 555 | 67 | 15 | 0.1 | 0 | 0 | 10.8 | 67 |
| | 37 | 519 | 543 | 67 | 22 | 0.5 | 0 | 0 | 9.9 | 62 |
| | 38 | 615 | 629 | 67 | 13 | 0.7 | 0 | 0.5 | 11.3 | 76 |
| | 39 | 695 | 712 | 60 | 5 | 1.5 | 0.2 | 0.5 | 11.3 | 57 |
| | 40 | 619 | 629 | 59 | 15 | 0.6 | 0 | 0.5 | 1.4 | 9 |
| | 41 | 500 | 510 | 69 | 15 | 0.2 | 0 | 0 | 13.2 | 80 |
| | 42 | 618 | 630 | 60 | 15 | 0.6 | 0 | 0.5 | 1.4 | 9 |
| | 43 | 501 | 512 | 70 | 15 | 0.1 | 0 | 0 | 13.3 | 65 |

*Ave. D: Average diameter

Example 2

Using Cu—Co—Si alloys, respectively containing Co, Si, and the balance of Cu and inevitable impurities according to mass concentrations listed in Table 3, test specimens were prepared by the same method of manufacturing with No. 27 in Example 1. The thus-obtained test pieces were evaluated with respect to the characteristics in the same way with Example 1. Results were summarized in Table 4. It is understood that the effects of the present invention may be obtained, also under the addition of various elements.

TABLE 3

| | Additional elements | | | |
|---|---|---|---|---|
| No | Co mass % | Si mass % | Co/Si | Others mass % |
| 2-1 | 1.2 | 0.3 | 4.0 | Ni: 0.5, As: 0.1, Sb: 0.1 |
| 2-2 | 1.2 | 0.3 | 4.0 | Cr: 2.0 |
| 2-3 | 1.2 | 0.3 | 4.0 | Sn: 0.1, P: 0.1, Mn: 0.1 |
| 2-4 | 1.2 | 0.3 | 4.0 | Mg: 0.1, B: 0.1, Al: 0.1 |
| 2-5 | 1.2 | 0.3 | 4.0 | Ag: 1, Be: 0.2 |
| 2-6 | 1.2 | 0.3 | 4.0 | Ti: 0.2, Zr: 0.1, Fe: 0.1 |

TABLE 4

| | | | | | 0.3 mmt W-Bending | 0.2 mmt W-Bending | 0.2 mmt 180°-Bend. | 1,000,000 × TEM: 2nd phase particles | |
|---|---|---|---|---|---|---|---|---|---|
| No | YS MPa | TS MPa | EC % IACS | GS μm | (B.W.) MBR/t | (B.W.) MBR/t | (B.W.) MBR/t | Ave. D* nm | Distance nm |
| 2-1 | 705 | 721 | 63 | 12 | 0.6 | 0 | 0.4 | 5.1 | 31 |
| 2-2 | 648 | 657 | 69 | 13 | 0.5 | 0 | 0 | 5.3 | 32 |
| 2-3 | 657 | 667 | 65 | 10 | 0.5 | 0 | 0 | 5.2 | 33 |
| 2-4 | 664 | 672 | 65 | 15 | 0.5 | 0 | 0 | 5.1 | 31 |
| 2-5 | 728 | 734 | 64 | 13 | 0.5 | 0 | 0 | 5.2 | 32 |
| 2-6 | 665 | 674 | 70 | 15 | 0.5 | 0 | 0 | 5.0 | 30 |

*Ave. D: Average diameter

Example 3

Cu—Co—Si alloys, respectively containing Co, Si, and the balance of Cu and inevitable impurities according to mass concentrations listed in Table 5, were processed in the same way with No. 5 in Example 1 up to the first aging, and then subjected to the first cold rolling with a reduction of 95% or larger.

Next, the solution treatment was conducted at a material temperature of 900° C., for a heating time of 100 seconds, followed by water cooling.

Next, the second cold rolling was conducted with each predetermined reduction listed in Table 5, followed by the second aging, to thereby produce test specimens of 0.2 mm thick and 0.3 mm thick. The processes were arbitrarily interposed by machining, acid pickling, and degreasing.

The thus-obtained test specimens were evaluated with respect to the characteristics in the same way with Example 1. Results were summarized in Table 6. It is understood that the effects of the present invention may be obtained, even if the order of the aging and the cold rolling was inverted, by lowering the aging temperature by (reduction×2)° C.

TABLE 5

| | Additional elements | | | Reduction of 2nd | 2nd Aging conditions | | | | | | Rate of temp, | Rate of temp, |
|---|---|---|---|---|---|---|---|---|---|---|---|---|
| | | | | | 1st Step | | 2nd Step | | 3rd Step | | | |
| No | Co mass % | Si mass % | Co/Si | cold rolling % | Aging temp. ° C. | Time h | Aging temp. ° C. | Time h | Aging temp. ° C. | Time h | rise ° C./h | drop ° C./h |
| 3-1 | 1.2 | 0.3 | 4.0 | 20% | 490 | 5 | | | | | 70 | 100 |
| 3-2 | 1.2 | 0.3 | 4.0 | 20% | 490 | 5 | 450 | 5 | | | 70 | 100 |
| 3-3 | 1.2 | 0.3 | 4.0 | 20% | 490 | 5 | 450 | 5 | 400 | 5 | 70 | 100 |
| 3-4 | 1.2 | 0.3 | 4.0 | 10% | 510 | 5 | 470 | 5 | 430 | 5 | 70 | 100 |
| 3-5 | 1.2 | 0.3 | 4.0 | 30% | 470 | 5 | 430 | 5 | 390 | 5 | 70 | 100 |

TABLE 6

| No | YS MPa | TS MPa | EC % IACS | GS μm | 0.3 mmt W-Bending (B.W.) MBR/t | 0.2 mmt W-Bending (B.W.) MBR/t | 0.2 mmt 180°-Bend. (B.W.) MBR/t | 1,000,000 × TEM: 2nd phase particles Ave. D* nm | Distance nm |
|---|---|---|---|---|---|---|---|---|---|
| 3-1 | 613 | 641 | 62 | 15 | 0.4 | 0 | 0 | 5.0 | 31 |
| 3-2 | 615 | 645 | 67 | 15 | 0.4 | 0 | 0 | 5.0 | 30 |
| 3-3 | 623 | 653 | 69 | 15 | 0.4 | 0 | 0 | 5.1 | 32 |
| 3-4 | 619 | 638 | 69 | 15 | 0.3 | 0 | 0 | 5.1 | 32 |
| 3-5 | 630 | 661 | 69 | 15 | 0.4 | 0 | 0 | 5.1 | 32 |

*Ave. D: Average diameter

The invention claimed is:

1. A copper alloy for electronic material comprising 0.5 to 3.0% by mass of Co, 0.1 to 1.0% by mass of Si, optionally one or more alloying elements selected from the group consisting of Ni, Sn, P, Mg, Mn, As, Sb, B, Ti, Zr, Al and Fe, wherein the content of any such alloying element, if present, is 0.5% by mass or less, and the total content of all alloying elements is 1.5% mass % or less, the balance being Cu and inevitable impurities, said copper alloy having a ratio of mass percentages of Co and Si (Co/Si) given as 3.5≤Co/Si≤5.0, wherein second phase particles having a particle size in the range of 1 to 50 nm seen in a cross-section taken in parallel with the direction of rolling, have an average particle size of 2 to 5 nm, and have an average distance between adjacent particles of 10 to 30 nm, and wherein a foil sample of the copper alloy measuring 100 mm wide by 200 mm long by 0.2 mm thick has a MBR/t value of 0.4 or less, said MBR/t value determined by:

determining the minimum bend radius (MBR) that does not cause cracking in the sample at the bend point of the sample, when the sample is (i) bent about 170° with the axis of bending aligned in the same direction in which the sample has been rolled during fabrication, with a predetermined inner bending radius to form a bending member having a bending portion and straight portions; and (ii) pressed to increase the bend of the bending portion from 170° to 180° while an insert having a thickness equal to double the predetermined inner bending radius is positioned between the straight portions of the bending member; and dividing the minimum bend radius thus determined by 0.2 mm, to provide the sample MBR/t.

2. The copper alloy for electronic material according to claim 1, wherein the average crystal grain size seen in a cross-section taken in parallel with the direction of rolling is 3 to 30 μm.

3. The copper alloy for electronic material according to claim 1, further comprising at least any one alloying element selected from the group consisting of Ni, Sn, P, Mg, Mn, As, Sb, B, Ti, Zr, Al and Fe.

4. The copper alloy for electronic material according to claim 2, further comprising at least any one alloying element selected from the group consisting of Ni, Sn, P, Mg, Mn, As, Sb, B, Ti, Zr, Al and Fe.

5. Wrought copper alloy product obtained by processing the copper alloy for electronic material described in claim 1.

6. Wrought copper alloy product according to claim 5, wherein the average crystal grain size seen in a cross-section taken in parallel with the direction of rolling is 3 to 30 μm.

7. Wrought copper alloy product according to claim 5, further comprising at least any one alloying element selected from the group consisting of Ni, Sn, P, Mg, Mn, As, Sb, B, Ti, Zr, Al and Fe.

8. Wrought copper alloy product according to claim 6, further comprising at least any one alloying element selected from the group consisting of Ni, Sn, P, Mg, Mn, As, Sb, B, Ti, Zr, Al and Fe.

9. An electronic component comprising the copper alloy for electronic material described in claim 1.

10. An electronic component according to claim 9, wherein the average crystal grain size seen in a cross-section taken in parallel with the direction of rolling is 3 to 30 μm.

11. An electronic component according to claim 9, further comprising at least any one alloying element selected from the group consisting of Ni, Sn, P, Mg, Mn, As, Sb, B, Ti, Zr, Al and Fe.

12. An electronic component according to claim 10, further comprising at least any one alloying element selected from the group consisting of Ni, Sn, P, Mg, Mn, As, Sb, B, Ti, Zr, Al and Fe.

* * * * *